US005604021A

United States Patent [19]

Wagner

[11] Patent Number: 5,604,021

[45] Date of Patent: Feb. 18, 1997

[54] MULTI-LAYER SUPPORT PAD HAVING REGIONS OF DIFFERING FIRMNESS

[75] Inventor: Robert F. Wagner, Medina, Ohio

[73] Assignee: Ohio Mattress Company Licensing and Components Group, Cleveland, Ohio

[21] Appl. No.: 363,260

[22] Filed: Dec. 23, 1994

[51] Int. Cl.[6] ..... A47C 27/14; B32B 7/02

[52] U.S. Cl. ..... 428/218; 5/736; 428/158; 428/167; 428/170; 428/310.5; 428/314.2; 428/316.6

[58] Field of Search ..... 428/159, 167, 428/170, 218, 310.5, 316.6, 158, 314.2; 5/464, 481

[56] References Cited

U.S. PATENT DOCUMENTS

| | | | |
|---|---|---|---|
| 2,192,601 | 3/1940 | Mattison | 5/355 |
| 3,047,888 | 8/1962 | Shecter et al. | 5/361 |
| 3,210,781 | 10/1965 | Pollock | 5/351 |
| 3,833,259 | 9/1974 | Pershing | 297/452 |
| 3,885,258 | 5/1975 | Regan | 5/345 R |
| 4,120,516 | 10/1978 | Takamatsu et al. | 428/316.6 X |
| 4,777,855 | 10/1988 | Cohen | 83/862 |
| 4,999,868 | 3/1991 | Kraft | 5/464 |
| 5,022,111 | 6/1991 | Fenner, Sr. | 5/481 |
| 5,066,531 | 11/1991 | Legg et al. | 428/316.6 X |
| 5,136,740 | 8/1992 | Kraft | 5/464 |
| 5,138,730 | 8/1992 | Masuda | 5/481 |
| 5,160,785 | 11/1992 | Davidson, Jr. | 428/316.6 |
| 5,163,194 | 11/1992 | Dixon | 5/636 |

*Primary Examiner*—Marion E. McCamish
*Assistant Examiner*—Blaine R. Copenheaver
*Attorney, Agent, or Firm*—Calfee Halter & Griswold

[57] ABSTRACT

A laminated support pad includes layers of material having different density in which voids are formed to extend through at least partial cross-sections of at least two adjacent layers to form regions of the pad having different support characteristics determined by the placement and extent of the voids in the laminated layers. Lamination of a layer of high density material on top of a layer of relatively low density material produces a relatively firm pad having varying degrees of firmness dependent upon the placement and extent of the voids. Conversely, lamination of layer of low density material on a top surface of a layer of relatively high density material produces a relatively soft pad also having varying degrees of firmness dependent upon the placement and extent of the voids. The pad can be cut to conform to conventional mattress sizes, and the regions formed in areas of the pad which correspond to the weight bearing requirements for optimum support of the human body in prone positions.

18 Claims, 3 Drawing Sheets

MULTI-LAYER SUPPORT PAD HAVING REGIONS OF DIFFERING FIRMNESS

FIELD OF THE INVENTION

The present invention relates generally to foam padding and, in particular, to laminated foam padding for support of the human body.

BACKGROUND OF THE INVENTION

Elastomeric foam materials, such as polyurethane, are commonly used to form sleeping support pads for humans. Such pads provide a soft surface which deflects proportionally in response to applied loads, dependent upon the density and indentation load deflection (ILD) value of the foam material. ILD values represent an amount of displacement force required to displace a pad a predetermined percentage of a total thickness of the pad. However, a foam pad of homogeneous density and uniform ILD deflects a uniform extent at all areas subjected to a certain minimum load. It has been proposed to layer materials of differing densities and ILDs in order to provide more even support to all parts of a human body in a prone position upon the pad. For example, U.S. Pat. Nos. 3,047,888, 3,833,259 and 3,885,258 each disclose laminated layers of foam materials having differing degrees of resiliency. In these types of laminated foam pads, the top layers are typically of lower density than the lower or inner layers in order to increase the initial softness ratio while maintaining sufficient firmness. This construction limits the types of pads which can be formed to having a soft surface and firm core.

Contoured surfaces have been formed in the top surfaces of top layers of laminate foam pads to improve weight distribution, increase the initial softness ratio, and vary the firmness of the top layer, as described in U.S. Pat. Nos. 4,999,868, 5,022,111 and 5,136,740. U.S. Pat. No. 4,999,868 describes varying the firmness of the top contoured layer by varying the depth of the grooves which form the contours. The grooves are formed entirely within a single top layer of the pad. U.S. Pat. No. 5,022,111 describes formation of contours in outer layers of a pad which have a density greater than an inner layer. However, the contours do not extend into the inner layer. Thus, these approaches do not exploit any of the support characteristic benefits which can be achieved by forming contours or grooves which extend through at least partial cross-sections of multiple laminated layers of differing density.

SUMMARY OF THE INVENTION

The present invention uniquely provides a laminated foam pad and method of making which advantageously maximizes support characteristic combinations of laminated soft and firm layers of foam material.

In accordance with one aspect of the invention, layers of relatively soft and firm foam are laminated together in a planar adjacent relationship and firmness altering voids formed through at least partial cross-sections of adjacent laminated layers to form regions of the pad which have different support characteristics.

In accordance with another aspect of the invention, firmness altering voids are formed in a partial cross-section of a laminate of two layers, one the layers having a density less than the other layer, and the voids are in the form of grooves which extend entirely through one of the layers.

In accordance with another aspect of the invention, a third layer is laminated to two adjacent layers having different densities and firmness altering voids which extend through at least a partial cross-section of the two adjacent layers.

These and other aspects of the invention will become apparent to those skilled in the art upon the reading and understanding of the following detailed description made with reference to the annexed drawings, wherein like reference numerals refer to like parts.

DETAILED DESCRIPTION OF PREFERRED EMBODIMENTS

Figure 1:
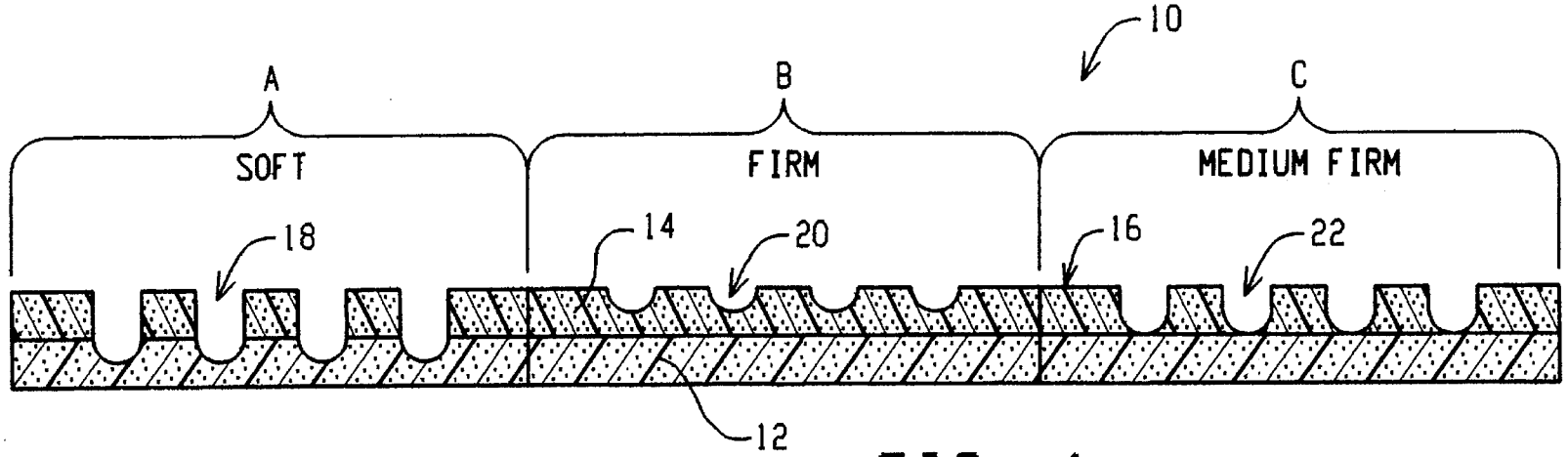
FIG. 1 is a cross-sectional view of a laminated support pad of the present invention.

As illustrated by the Figures, the inventive support pad 10 includes at least two laminated layers including a relatively soft layer 12 and a relatively firm layer 14 made of, for example, polyurethane foam.

To achieve the difference in support characteristics between the two layers, soft layer 12 may be formed of a particular type of foam to have a density in a range of approximately one (1) to three (3) lbs/ft$^3$, while firm layer 14 may be formed of a different type of foam to have a density in a range of approximately 20 to 50 lb/ft$^3$. Also, firm layer 14 may be formed to have an ILD value which is lower than an ILD value for soft layer 12. For example, firm layer 14 may have an ILD value of 30 which is less than an ILD value for soft layer 12.

Layers 12 and 14 may each be formed to have a thickness dimension of, for example, 1 cm to 30 cm and width and length dimensions adapted to conventional mattress sizes. Of course, any dimension of any of the layers of the pad 10 may be altered as desired.

In the embodiment illustrated by FIG. 1, firm layer 14 is laminated on top of soft layer 12. From a top surface 16 of firm layer 14, a plurality of grooves 18, 20 and 22 are formed to extend through a cross-section of firm layer 14 and may further extend through a partial cross-section of underlying soft layer 12. In this embodiment, the pad is defined into three regions A, B and C of varying support characteristics determined by the vertical extent or depth of grooves 18 from top surface 16.

In region A, grooves 18 extend through an entire cross-section of firm layer 14 and partially into underlying soft layer 12. The substantial amount of firm layer 14 removed in combination with the amount of soft layer 12 also removed from the laminate by the extent and lateral placement of grooves 18 produces an area of the pad which is relatively soft, i.e., having a relatively high ILD value.

In region B, placed at an area of highest loading in human body support, grooves 20 are formed to extend through only a partial cross-section of firm layer 14 to produce an area of the pad which is relatively firm, i.e., having a relatively low ILD value, i.e., lower than regions A and C.

In region C, grooves 22 are formed to extend through an entire cross-section of firm layer 14, terminating at a top surface 24 of soft layer 12, to provide an area of the pad which is intermediate in firmness to regions A and B, i.e., having an ILD value greater than region B but less than region A.

Figure 2:
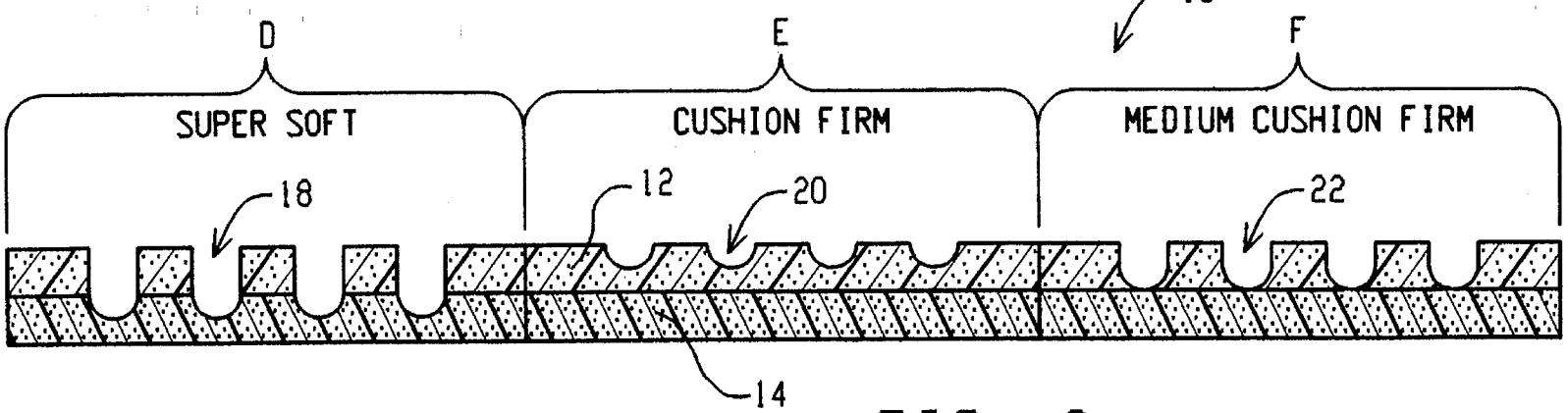
FIG. 2 is a cross-sectional view of an alternate embodiment of a laminated support pad of the present invention.

In the embodiment of FIG. 2, soft layer 12 is laminated on top surface 16 of firm layer 14 to form a laminated pad which is generally softer but also with regions of different support characteristics. Grooves 18, 20 and 22 are formed through cross-sections of the laminate to define regions D, E and F which, in a laminate having this reversed order of layers, produces a pad having support characteristics different than the regions A, B and C of the embodiment of FIG. 1. In general, by placing soft layer 12 on top, each of the regions D, E and F are relatively softer than corresponding regions A, B and C of the embodiment of FIG. 1.

In region D, grooves 18 are again formed to extend through an entire cross-section of soft layer 12 and through a partial cross-section of underlying firm layer 14 provides an area of the pad which is relatively very soft, i.e., having an ILD value higher than that for region A.

In region E, grooves 20 are formed to extend vertically through only a partial cross-section of soft layer 12 to produce an area of the pad which is relatively firm, i.e., having a relatively low ILD value but greater than the ILD value of region B of the embodiment of FIG. 1.

In region F, grooves 22 are formed to extend through an entire cross-section of soft layer 12 and terminate at top surface 16 of firm layer 14 to provide an area of the pad which is intermediate in firmness to regions D and E, i.e., having an ILD value greater than region E but lower than region D and higher than corresponding region C.

Figure 3:
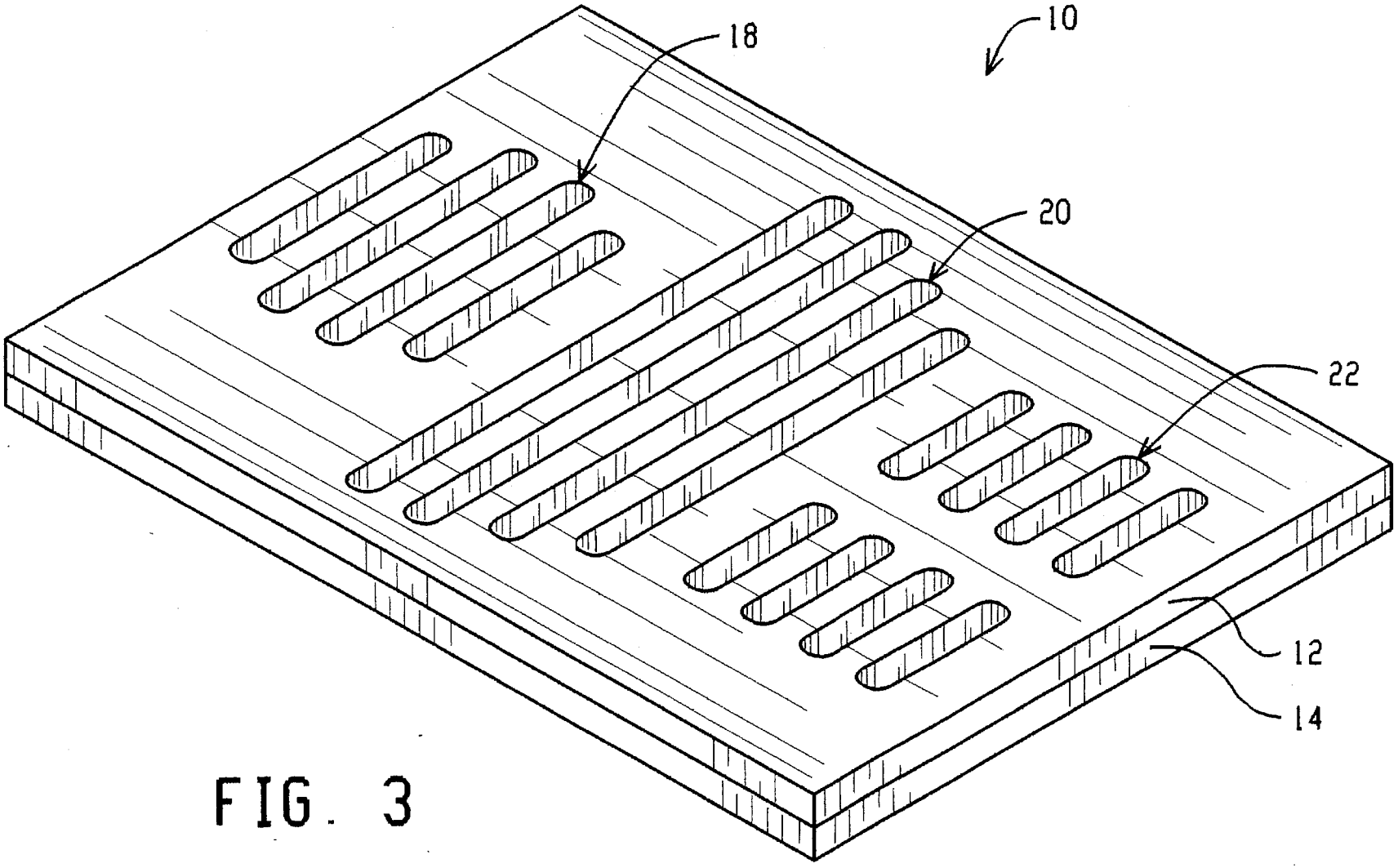
FIG. 3 is a perspective view of a laminated support pad of the present invention.

The overall firmness of any of the regions can be altered by variation of the depth of the grooves and variation of the lateral placement of and spacing between the grooves. Also, as shown in FIG. 3, grooves of selected depths can be selectively placed over the total surface area of the pad to shape the regions as desired.

Figure 4:
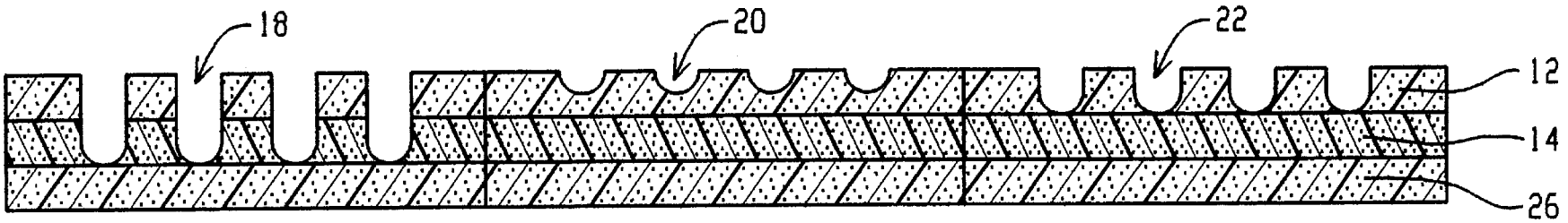
FIG. 4 is a cross-sectional view of a laminated support pad of the present invention.

As shown in FIG. 4, an additional layer of padding 26 may be laminated to the two layers of the embodiments of FIGS. 1 and 2. In this embodiment, it is possible to form grooves which extend entirely through the cross-sections of both soft layer 12 and firm layer 14 to form a very soft region of the pad.

Thus it is disclosed that by combining laminated layers of material of different densities and providing void areas in the form of grooves which extend through at least a partial cross-section of adjacent laminated layers, a support pad can be formed to have regions of different support characteristics determined by placement, spacing and depth of the grooves in the laminated layers.

Although the invention has been shown and described with respect to certain preferred embodiments, modifications to the embodiments and variations on the basic concepts of the invention may become apparent to those skilled in the art upon reading this specification. All such modifications and variations are with the scope of the invention which is defined for now by the following claims and equivalents thereto.

What is claimed is:

1. A foam support pad having a plurality of regions wherein the support characteristics of one region are different from the support characteristics of another region, the support pad comprising:

a first foam layer, a second foam layer laminated to the first foam layer so that a top surface of the second foam layer serves as a top surface of the support pad, a plurality of voids formed in one area of the pad to extend from the top surface of the pad through a partial cross-section of the second foam layer to define a firm region of the pad, a plurality of voids formed in a different area of the pad to extend from the top surface of the pad through an entire cross-section of the second foam layer to define a moderately firm region of the pad, and a plurality of voids formed in another area of the pad to extend from the top surface of the pad through an entire cross-section of the second foam layer and through at least a partial cross-section of the first foam layer to define a soft region of the pad;

wherein the density of the material of the first foam layer differs from the density of the material of the second foam layer.

2. The support pad of claim 1 wherein the plurality of voids are in the form of U-shaped grooves having an open end in the top surface of the pad and a rounded bottom in one of the foam layers.

3. The support pad of claim 1 wherein the voids within each region are spaced apart a uniform distance.

4. The support pad of claim 1 wherein each of the regions extend substantially across a width of the pad.

5. The support pad of claim 1 wherein the soft region is formed at one end of the pad and the moderately firm region is formed at an opposite end of the pad.

6. The support pad of claim 1 further comprising at Least one additional padding layer laminated to the first foam layer or second foam layer.

7. A support pad having a mop and a bottom, said support pad defining a plurality of regions wherein the support characteristics of one region differs from the support characteristics of another region, the support pad comprising:

an upper foam layer having a first density, a lower foam layer under said upper foam layer, said lower foam layer having a second density different from the first density, a first of said regions having a first set of voids extending through said upper foam layer, whereby said first region defines a support characteristics of a first firmness, and a second of said regions having a second set of voids extending through said upper foam layer and said lower foam layer, whereby said second region defines support characteristics of a second firmness less firm than said first firmness;

wherein the density of said upper foam layer is essentially uniform in said first and second regions and further wherein the density of said lower foam layer is essentially uniform in said first and second regions, said first and second regions exhibiting different support characteristics due to a difference in the number, placement or extent of the voids in each such region;

wherein the voids in said second set of voids extend all the way through said upper foam layer and all the way through said lower foam layer, said pad further comprising a third padding layer under said lower foam layer.

8. The paid of claim 7, wherein said paid includes a third region defining a third set of voids, said third region defining support characteristics of a third firmness intermediate said first and second firmnesses.

9. The pad of claim 8, wherein the voids in said first set of voids extend from the top of said pad towards the bottom of said pad by a first distance, wherein the voids in said second set of voids extend from the top of said pad towards the bottom of said pad by a second distance greater than said first distance, and wherein the voids in said third set of voids extend from the top of said pad towards the bottom of said pad by a third distance intermediate said first and second distances.

10. The pad of claim 9, wherein the voids in said first set of voids extend partially through said upper foam layer, and further wherein the voids in said third set of voids extend all the way through said top layer.

11. The pad of claim 7, wherein the voids are in the form of grooves having openings in a top surface of the pad and bottoms in one of the layers of the pad.

12. The pad of claim 11, wherein the grooves are generally linear and are formed in a direction parallel to a width of the pad.

13. The pad of claim 12, wherein the grooves extend across a substantial width of the pad.

14. The pad of claim 7, wherein the density of the material of said upper foam layer is greater than the density of the material of said lower foam layer.

15. The pad of claim 7, wherein the density of the material of said upper foam layer is less than the density of the material of said lower foam layer.

16. The pad of claim 7, wherein said upper foam layer and said lower foam layer extend across the entire area of said pad.

17. A support pad having a top and a bottom, said support pad defining a plurality of regions wherein the support characteristics of one region differs from the support characteristics of another region, the support pad comprising:

an upper foam layer having a first density, a lower foam layer under said upper foam layer, said lower foam layer having a second density different from the first density, a first of said regions having a first set of voids extending through said upper foam layer, whereby said first region defines a support characteristics of a first firmness, and a second of said regions having a second set of voids extending through said upper foam layer and said lower foam layer, whereby said second region defines support characteristics of a second firmness less firm than said first firmness;

wherein the density of said upper foam layer is essentially uniform in said first and second regions and further wherein the density of said lower foam layer is essentially uniform in said first and second regions, said first and second regions exhibiting different support characteristics due to a difference in the number, placement or extent of the voids in each such region;

wherein the voids in said second set of voids extend all the way through said upper foam layer and all the way through said lower foam layer, said pad further comprising a third padding layer under said lower foam layer;

wherein said pad includes a third region defining a third set of voids, said third region defining support characteristics of a third firmness intermediate said first and second firmness;

wherein the voids of the first set of voids extend from the top of said pad towards the bottom of said pad by a first distance, wherein the voids of in said second set of voids extend from the top of said pad towards the bottom of said pad by a second distance greater than said first distance, and wherein the voids in said third set of voids extend from the top of said pad towards the bottom of said pad by a third distance intermediate said first and second distances.

18. The pad of claim 17, wherein the voids in said first set of voids extend partially through said upper foam layer, and further wherein the voids in said third set of voids extend all the way through said upper foam layer.

* * * * *

UNITED STATES PATENT AND TRADEMARK OFFICE

CERTIFICATE OF CORRECTION

PATENT NO. : 5,604,021
DATED : Feb. 18, 1997
INVENTOR(S) : Wagner

It is certified that error appears in the above-indentified patent and that said Letters Patent is hereby corrected as shown below:

claim 7, col. 4, line 34, delete "mop" and insert --top--.

Signed and Sealed this

Twenty-seventh Day of May, 1997

*Attest:*

Bruce Lehman

BRUCE LEHMAN

*Attesting Officer*

*Commissioner of Patents and Trademarks*